US005848595A

United States Patent [19]

Arthur

[11] Patent Number: 5,848,595

[45] Date of Patent: Dec. 15, 1998

[54] CIGARETTE PACKAGE WITH ASHTRAY

[76] Inventor: Will Eugene Arthur, 6876 Lariat La., Castro Valley, Calif. 94553

[21] Appl. No.: 924,486

[22] Filed: Aug. 21, 1997

Related U.S. Application Data

[62] Division of Ser. No. 728,936, Oct. 11, 1996.

[51] Int. Cl.[6] ..... B65D 85/10

[52] U.S. Cl. ..... 131/238; 206/246; 55/385.8; 131/231

[58] Field of Search ..... 131/231, 232, 131/237, 242, 241, 238; 206/246, 248, 254; 55/385.8

[56] References Cited

U.S. PATENT DOCUMENTS

| | | |
|---|---|---|
| 1,562,497 | 11/1925 | Derry . |
| 2,085,062 | 6/1937 | Allen . |
| 2,233,324 | 2/1941 | Palmer . |
| 2,585,923 | 2/1952 | Epler et al. . |
| 2,944,555 | 7/1960 | Peel et al. . |
| 2,958,417 | 11/1960 | Adams . |
| 2,999,584 | 9/1961 | Gillespie . |
| 3,018,877 | 1/1962 | Posavic . |
| 3,018,878 | 1/1962 | Watkins . |
| 3,029,931 | 4/1962 | Watkins . |
| 3,057,465 | 10/1962 | Quercio, Jr. . |
| 3,096,878 | 7/1963 | Whitley et al. . |
| 3,126,092 | 3/1964 | Maron . |
| 3,388,706 | 6/1968 | Muirheid . |
| 3,888,264 | 6/1975 | Baclit . |
| 4,148,618 | 4/1979 | Christenson et al. . |
| 4,886,161 | 12/1989 | Keidar et al. . |
| 4,961,496 | 10/1990 | Focke et al. . |
| 5,178,272 | 1/1993 | Evers . |
| 5,368,155 | 11/1994 | Ewen . |
| 5,480,025 | 1/1996 | Draucker et al. . |

*Primary Examiner*—Stanley S. Silverman
*Assistant Examiner*—Steven B. Leavitt

[57] ABSTRACT

A cigarette package comprising an inner and outer section can be slidably connected so that an ashtray portion can be formed when the cigarette package is placed in the extended position. The inner section can be a cigarette holding portion which allows the cigarettes to be accessed in this extended position. In a closed position, the lid for the cigarette package can be prevented from opening by the outer section. Additionally, the use of a hole in the package about the same diameter as a cigarette can be used to extinguish butts placed into the ashtray portion. Furthermore, a vacuum device can be used to turn the ashtray portion into a smokeless ashtray.

5 Claims, 4 Drawing Sheets

CIGARETTE PACKAGE WITH ASHTRAY

This is a division of application Ser. No. 08/728,936 filed Oct. 11, 1996.

BACKGROUND OF THE INVENTION

This invention relates to ashtrays attached to cigarette packages.

Smokers huddling together outside of office buildings is a common urban sight. This is a result of regulations that restrict the availability of smoking in buildings. These outdoor smokers are often far from any ashtray, which can unfortunately result in cigarette butts accumulating as trash on the ground.

For this reason, there is currently a need for a cigarette package having an attached ashtray. Prior art cigarette packages with enclosed ashtrays include Derry U.S. Pat. No. 1,562,497; Whitley et al. U.S. Pat. No. 3,096,878; Peel et al. U.S. Pat. No. 2,944,555; and Maron et al. U.S. Pat. No. 3,126,092. These prior art cigarette packages generally are difficult to manufacture and may have problems ensuring that the cigarette butts will extinguish. Additionally, the Derry et al. cigarette package is partially constructed of a metal material.

It is desired to have an improved design of a cigarette package with an enclosed ashtray.

SUMMARY OF THE PRESENT INVENTION

The present invention comprises a two-part cigarette package. An inner section is slidably connected to an outer section. The inner section contains the cigarettes and slides within the slightly larger outer section from a closed position to an extended position. In the closed position, the cigarette package is compact, having a size comparable to the normal cigarette package size. In the extended position, an ashtray portion is defined. Preferably, in the closed position, the inner section is prevented from opening. This means that the ashtray section is available whenever the cigarettes are withdrawn from the inner section.

The ashtray portion formed in the extended position can be used to receive ashes and cigarette butts through the flip-top lid. Flip-top lids are commonly used with hardpack cigarette cases and are thus not difficult to manufacture. In flip-top lids, the lid comprises the end and portions of the sides of the section. A filter can be positioned in the bottom of the flip-top lid or elsewhere in the ashtray to remove or mask odors.

Additionally, a hole in the side of the package about the size of a cigarette's diameter allows for butts to be put into the ashtray portion from outside. Since the size of this hole is about the same size as a cigarette's diameter, the supply of oxygen to the cigarette butts is limited and the butt will be extinguished. This feature does not appear to be shown in prior cigarette packaging. Perforations on the package can allow the user to pop open the hole on the side of the package. This hole is blocked by the inner section while in the closed position. While in the extended position, the hole provides access to the ashtray, portion.

When a flip-top lid is used for access to the ashtray portion, a locking extension can be provided which surrounds the hole in the outer section. When a cigarette is placed partially within the hole, the locking extension will lock the ashtray portion closed. An advantage of the present invention is that it can be produced out of cardboard or other paper products which are usually used for producing a hard cigarette package.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE PREFERRED EMBODIMENT

Figure 1:
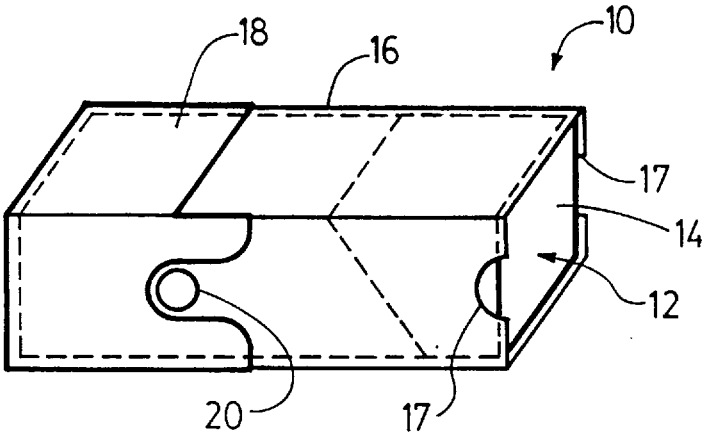
FIG. 1 is a diagram of a cigarette package with enclosed ashtray portion in the closed position.

FIG. 1 is a diagram of a cigarette package 10. The package 10 includes an inner portion 12 including a flip-top lid 14 which fits within an outer section 16. Outer section 16 has a flip-top lid 18. The outer section 16 also defines a hole 20 which is blocked in the closed position. The hole 20 can be produced from a perforated portion of the outer section 16. The outer portion 16 is open at one end. In a preferred embodiment, cutouts 17 are provided on the outer section 16 to allow the inner portion to be pulled into the extended position.

Figure 2:
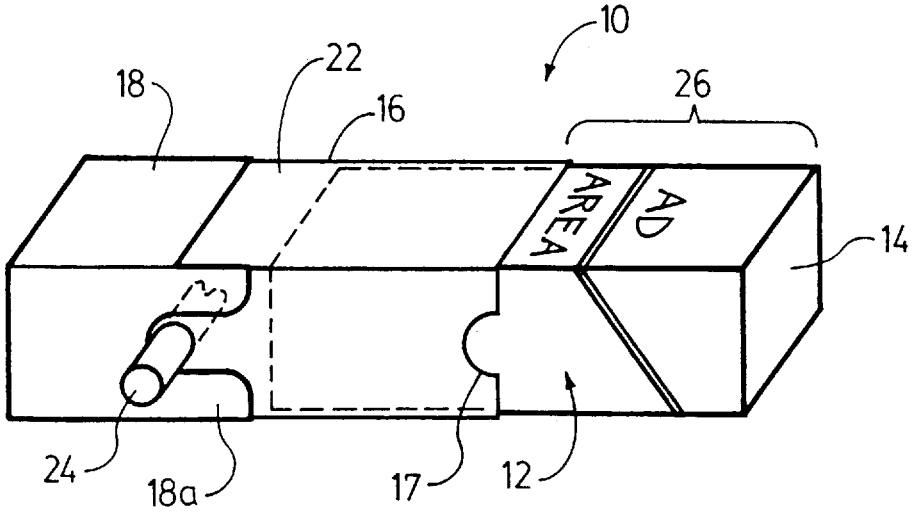
FIG. 2 is a diagram of a cigarette package with enclosed ashtray in the extended position.

FIG. 2 shows the cigarette package 10 in the extended position. Putting the cigarette package in the extended position produces an ashtray portion 22 out of the outer section 16. This ashtray portion 22 can be used to put out the cigarette and to store the ashes and cigarette butts. The hole 20 allows a cigarette butt such as cigarette butt 24 to be pushed through. Because the hole 20 is about the size of the cigarette butt 24, the cigarette butt is extinguished due to the limited supply of oxygen to the butt. The cardboard used in cigarette hardpacks has been found to be resistant to ignition when snuffing out cigarette butts. Alternately, an anti-flammable coating could be added to the ashtray portion.

An extension 18*a* on the flip-top lid can be used as a locking device that, when a butt 24 is in the hole 20, the flip-top lid 18 is prevented from accidentally opening. A advertising area 26, which is normally hidden by the outer section, can be revealed by putting the cigarette package into the extended position. This allows for promotion, advertising, or other messages to be displayed when the package is in the extended position, but remain hidden when the package is in the closed position shown in FIG. 1. The inner pack can provide as much as 22 square inches of additional advertising space.

Figure 3:
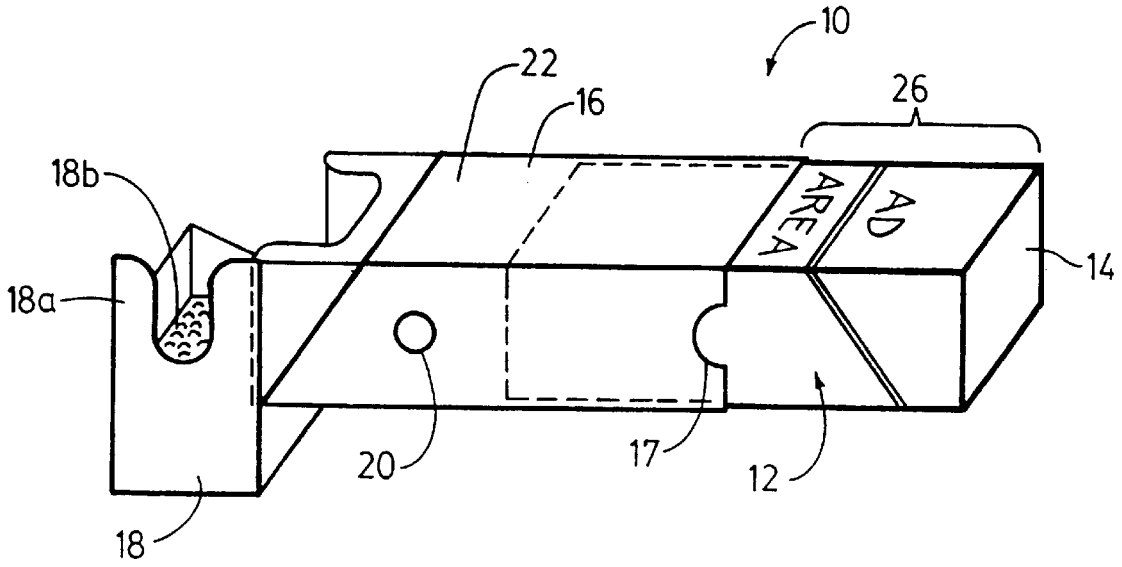
FIG. 3 is a diagram of a cigarette package with an ashtray in the extended position showing the ashtray lid open.

FIG. 3 shows the cigarette package 10 with the ashtray in the extended position showing the flip-top lid 18 open. In this position, the extension 18*a* of the flip-top lid 18 provides a holder for cigarettes. Additionally, a filter 18*b* can be placed in the bottom of the flip-top lid 18 or positioned elsewhere within the ashtray portion 22. The filter 18*b* can include a charcoal layer positioned between the lid and a cardboard layer having pinholes. Such a filter 18*a* can be easily constructed at the same time as the cardboard container. The charcoal layer absorbs some of the odors in the ashtray.

Figure 4:
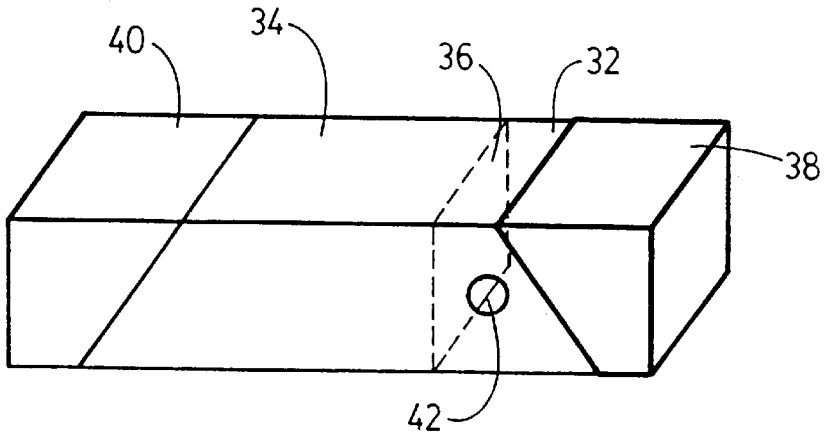
FIG. 4 is a diagram of an alternate embodiment of a cigarette package with ashtray.

FIG. 4 is a diagram of an alternate embodiment of a cigarette package 30 with an ashtray portion 32. In this embodiment, the ashtray portion 32 and the cigarette holding portion 34 are fixed in position with a barrier 36 separating these two portions. The cigarette holding portion 34 has a flip-top lid 40 and the ashtray portion 32 has a flip-top lid 38. The ashtray portion 32 has a hole 42 which forms an interference fit with the cigarette. The interference fit seals off the ashtray from outside oxygen causing the cigarette to extinguish..

Figure 5:
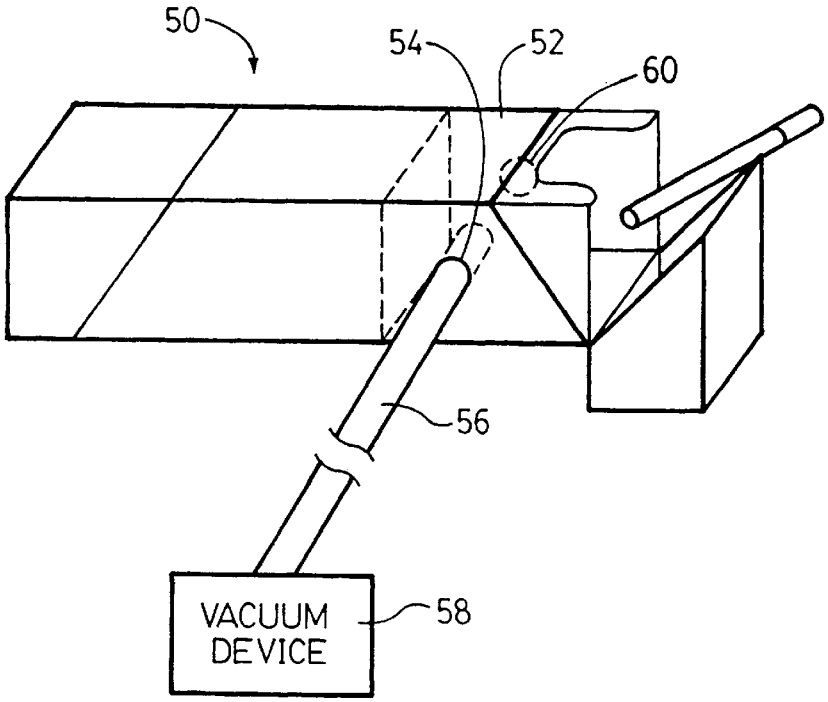
FIG. 5 is a diagram of an alternate embodiment of the present invention using a vacuum device.

FIG. 5 is a diagram of an alternate embodiment of the present invention using a vacuum device 58. The alternate embodiment uses a cigarette package 50 having an ashtray portion 52 with a hole 54 in the side. The hole 54 can be used as an exhaust port. Another hole 60 can optionally be used to hold a cigarette. A flexible hose 56 connected to the vacuum device 58 is inserted into the exhaust port 54. The vacuum device 58 will pull smoke from the cigarette pack 50 thereby producing a smokeless ashtray 52.

The vacuum device will preferably be battery powered using a fan and an air filter. The device prevents 50% to 70% of secondary smoke which affects people. The device allows the smoker to blow the smoke toward the ashtray 52 and through the tube to the vacuum device 58. The vacuum device 58 can be handheld or attached with a clip to a person's belt.

Figure 7A:
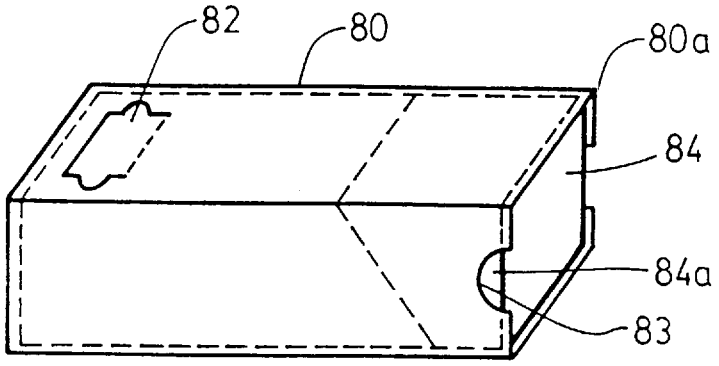
FIGS. 7A–7C are diagrams of an alternate embodiment of the present invention showing an outer shell.
Figure 7B:
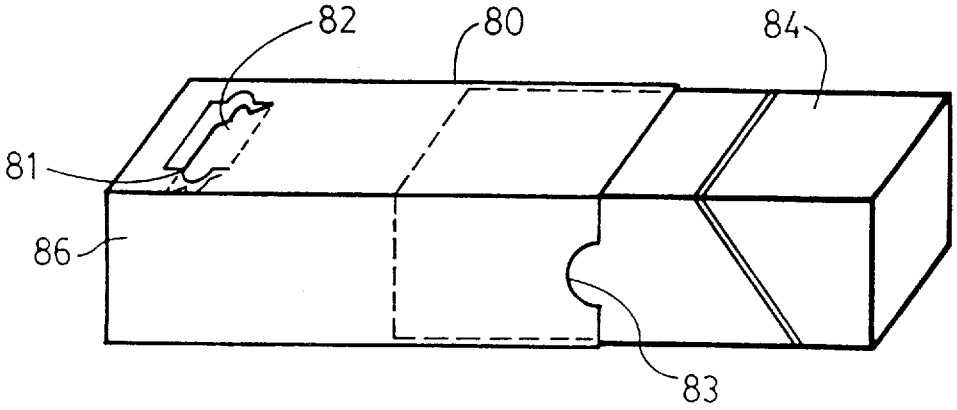
Figure 7C:
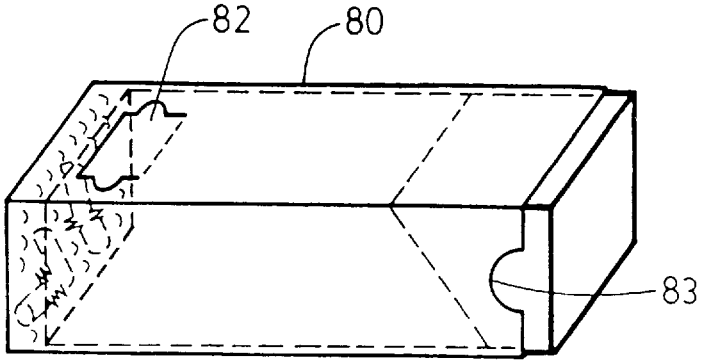

FIGS. 7A–7C are diagrams of an alternate embodiment of the present invention showing an outer shell 80. FIG. 7A shows the cigarette package in the closed position. A cigarette package 84 can slidably fit into the cavity of the outer shell 80. The outer shell 80 preferably includes an curved indentation 83 so that a portion 84*a* of the cigarette package 84 can be pulled on to remove the cigarette package from the outer shell 80. In the closed position, access to the cavity through the opening flap 82 is blocked by the cigarette package 84. FIG. 7B shows the cigarette package in the extended position. In the extended position, the flap 82 opens to an ashtray portion 86. FIG. 7C shows the cigarette package moved back to squish butts and ashes into the end portion. The opening flap 82 preferably opens inward so that the flap closes as the cigarette package is pushed toward the end section. The opening flap 82 preferably defines a curved portion 81 in the outer shell 80 that allows a cigarette to be rested in the ashtray. The outer shell 80 can be made of a plastic material and sized to fit a standard cigarette package. Alternately, the outer shell 80 can be made of paper and be a part of the cigarette package as sold.

There is preferably no lid attached to the mouth 80*a* of the outer shell 80. This allows the cigarette package 84 and outer shell 80 to form a compact unit even when cigarette butts are stored in the end portion. If a lid were placed at the mouth 80*a,* there would be a limit to the volume of butts that could be stored in the end portion before the lid would be unable to close. If the lid is unable to close, the entire unit becomes cumbersome. By having no lid, a substantial amount of butts can be stored in the end portion and the unit remains compact.

Figure 6A:
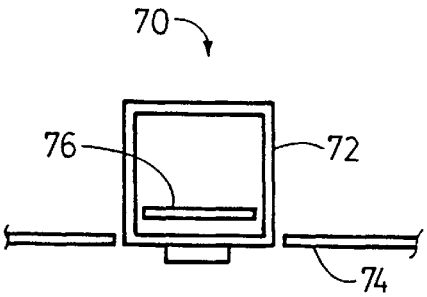
FIGS. 6A–6B are cross-sectional views of a car ashtray of an alternate embodiment of the present invention.
Figure 6B:
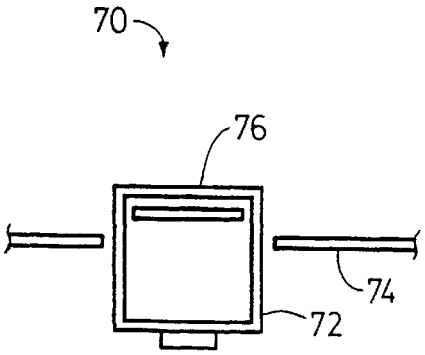

Another alternate embodiment uses the concepts of the present invention with respect to car ashtrays. FIGS. 6A–6B are cross-sectional views of a car ashtray of an alternate embodiment of the present invention. FIG. 6A shows the ashtray 70 in the closed position. FIG. 6B shows the ashtray 70 in the closed position. A tray portion 72 is slidably connected to a wall or dashboard 74 in the conventional manner. The tray 72 is open at its top. A backwall 76 is positioned in the tray 72. When the tray 72 is opened, the backwall 76 does not move so the space available to put a cigarette butts expands. When the tray 72 is closed, the volume of the ashtray is reduced and any cigarette butts in the tray 72 are crushed against the backwall 76.

Various details of the implementation and method are merely illustrative of the invention. It will be understood that changes of these details may be within the scope of the invention, which is to be limited only by the appended claims.

What is claimed is:

1. An apparatus comprising:

a cigarette package including a cigarette holding portion and an ashtray portion with a seperate lid from the cigarette holding portion wherein the ashtray portion has a hole for a hose; the hose having a determined diameter so that it fits into the hole when attached; and a vacuum device attached to the hose for removing smoke from the ashtray portion.

2. The apparatus of claim 1, wherein the hose has a diameter such that it is held in place by the hole.

3. The apparatus of claim 1, wherein said vacuum device comprises a fan and a filter.

4. The apparatus of claim 1, wherein said vacuum device includes a clip for attaching to a person's belt.

5. The apparatus of claim 1, wherein said ashtray has an additional hole.

* * * * *